US008205357B2

(12) United States Patent
Keating et al.

(10) Patent No.: US 8,205,357 B2
(45) Date of Patent: Jun. 26, 2012

(54) INTERCHANGEABLE MIDSOLE SYSTEM

(75) Inventors: Brian Keating, West Hills, CA (US); David Bond, Newbury Park, CA (US)

(73) Assignee: K-Swiss, Inc., Westlake Village, CA (US)

( * ) Notice: Subject to any disclaimer, the term of this patent is extended or adjusted under 35 U.S.C. 154(b) by 377 days.

(21) Appl. No.: 12/471,032

(22) Filed: May 22, 2009

(65) Prior Publication Data

US 2009/0293309 A1 Dec. 3, 2009

Related U.S. Application Data

(60) Provisional application No. 61/071,981, filed on May 29, 2008.

(51) Int. Cl.
*A43B 7/14* (2006.01)
*A43B 13/18* (2006.01)

(52) U.S. Cl. ..... 36/88; 36/24.5; 36/28; 36/15; 36/141

(58) Field of Classification Search ..... 36/24.5, 36/25 R, 28, 34 R, 36 R, 43–44, 68, 71, 128, 36/140–143, 88, 100–103, 114–115
See application file for complete search history.

(56) References Cited

U.S. PATENT DOCUMENTS 2,156,086 A 4/1939 Hack et al.
3,512,274 A * 5/1970 McGrath ..... 36/127
3,952,427 A * 4/1976 von den Benken et al. .... 36/103
4,258,480 A * 3/1981 Famolare, Jr. ..... 36/91
4,364,188 A * 12/1982 Turner et al. ..... 36/31
4,391,048 A * 7/1983 Lutz ..... 36/28
4,715,133 A * 12/1987 Hartjes et al. ..... 36/127
4,724,623 A 2/1988 Silverman
4,845,863 A 7/1989 Yung-Mao
4,897,936 A * 2/1990 Fuerst ..... 36/30 A
4,908,962 A 3/1990 Yung-Mao
D316,627 S 5/1991 Schneider
5,367,791 A * 11/1994 Gross et al. ..... 36/31
5,718,063 A * 2/1998 Yamashita et al. ..... 36/28
6,023,857 A 2/2000 Vizy et al.
6,038,790 A * 3/2000 Pyle et al. ..... 36/30 R
6,092,311 A 7/2000 MacNamara
6,189,241 B1 2/2001 Liu
6,408,543 B1 6/2002 Erickson et al.
6,474,003 B2 11/2002 Erickson et al.
6,708,427 B2 3/2004 Sussmann et al.
6,748,675 B2 * 6/2004 Sato ..... 36/30 R
D504,555 S 5/2005 Urie
6,922,919 B2 8/2005 Chenevert
6,976,323 B1 12/2005 Halliday
(Continued)

OTHER PUBLICATIONS

U.S. Appl. No. 12/790,386, filed May 28, 2010, Keating, et al.

(Continued)

*Primary Examiner* — Winnie Yip
(74) *Attorney, Agent, or Firm* — Rothwell, Figg, Earnst & Manbeck, P.C.

(57) ABSTRACT

Exemplary embodiments of the invention provide a shoe assembly having at least an outsole portion and a midsole portion, the midsole portion is removably engaged with the outsole to allow replacement of the midsole with another midsole having different structural features, and at least one projection extends from the midsole through an aperture of the outsole, the projection configured to engage with a corresponding aperture of the outsole to align and secure the midsole to the outsole.

22 Claims, 11 Drawing Sheets

U.S. PATENT DOCUMENTS

| | | | | |
|---|---|---|---|---|
| 7,010,869 | B1 * | 3/2006 | Ellis, III | 36/25 R |
| 7,171,768 | B2 * | 2/2007 | Klein | 36/101 |
| 7,284,344 | B2 | 10/2007 | Pawlus et al. | |
| 7,380,353 | B2 | 6/2008 | Feller et al. | |
| D573,336 | S | 7/2008 | Rivas et al. | |
| 7,523,566 | B2 * | 4/2009 | Young-Chul | 36/30 R |
| 7,918,041 | B2 * | 4/2011 | Cho | 36/3 B |
| 7,954,257 | B2 * | 6/2011 | Banik | 36/28 |
| 2001/0032399 | A1 | 10/2001 | Litchfield et al. | |
| 2004/0255486 | A1 | 12/2004 | Pawlus et al. | |
| 2005/0108896 | A1 | 5/2005 | Preskar et al. | |
| 2005/0108898 | A1 | 5/2005 | Jeppesen et al. | |
| 2005/0268491 | A1 | 12/2005 | McDonald et al. | |
| 2006/0277793 | A1 | 12/2006 | Hardy et al. | |
| 2007/0023955 | A1 | 2/2007 | Ho | |
| 2007/0084085 | A1 | 4/2007 | Klein | |
| 2007/0271817 | A1 | 11/2007 | Ellis, III | |
| 2008/0005933 | A1 | 1/2008 | Auger et al. | |
| 2008/0047167 | A1 | 2/2008 | Pawlus et al. | |
| 2008/0134543 | A1 | 6/2008 | Klein | |
| 2008/0168681 | A1 | 7/2008 | Andersen et al. | |
| 2008/0172904 | A1 | 7/2008 | Pelsue et al. | |
| 2008/0189982 | A1 | 8/2008 | Krafsur | |
| 2008/0196273 | A1 | 8/2008 | Kosta | |
| 2008/0216360 | A1 | 9/2008 | Schenone | |

OTHER PUBLICATIONS

U.S. Appl. No. 12/945,237, filed Nov. 12, 2010, Keating, et al.

Examination Report under Section 18(3), issued Mar. 30, 2012, in Great Britain Application GB1019350.6, filed Nov. 16, 2011.

* cited by examiner

INTERCHANGEABLE MIDSOLE SYSTEM

BACKGROUND

1. Field of the Invention

The present invention relates to a shoe having a midsole portion that can be quickly and easily exchanged.

2. Description of Related Art

The variety of activities and sports pursued has increased steadily in recent years. This increase has been sparked at least in part by advances in equipment technology which has allowed more people to enjoy a particular activity. Almost all sporting activities require the person to move themselves by walking or running. As such, the single most important piece of equipment is often the footwear worn by the user.

Athletic shoes, such as those designed for tennis, running, basketball, hiking, cross-training, walking and other activities, typically include a sole or sole assembly on a bottom portion of the shoe and an upper formed at a top part of the shoe. The sole assembly usually includes a rubber outsole that contacts the ground surface and a cushioning midsole or midsole assembly above the outsole. Therefore, there are three parts to most athletic shoes: the outsole, the midsole, and the insole.

In the related art, interchangeable insoles exist and are an after-market business. Insoles are generally 5 mm thick and sit on top of a lasted upper and the midsole/outsole. The midsole is the cushioning that sits between the lasted upper (which includes the insole) and the outsole. The midsole is generally thicker under the heel and the height of the midsole depends on the sport. Running shoes are generally thicker and court shoes are thinner.

In the related art, the outsole and the midsole are fixedly secured by gluing or other similar attachment process. Similarly, the sole assembly is fixedly secured to the soft and pliable upper portion of the shoe. However, a user may wish to have a different feel and performance from their shoes when practicing a sport, for example tennis, compared to when the user is playing in a competitive match in that sport.

SUMMARY

As discussed previously, a user may wish to change the feel and performance from a pair of shoes depending on the type and/or level of activity being performed. Providing the wearer of a shoe with the ability to replace or switch parts of the shoe and to achieve the desired performance and maintain the structural integrity of the shoe is advantageous to a user. That is, a versatile shoe having a midsole that can be switched to provide customized performance can be beneficial to a user. Such a shoe is not provided by the related art.

Accordingly, it is an object of exemplary embodiments of the present invention to provide a shoe with a replaceable midsole portion.

By way of example, the invention can separately provide methods for easily interchanging and replacing the midsole portion with other removable midsole portions when a user wishes to switch the currently used midsole portion.

According to an example of the invention, a user can choose from a plurality of replaceable midsole portions, each of the midsole portions provides a different support structure that allows the user to maximize the performance provided by the shoe. A user could select a midsole that is more advantageous for a particular surface and/or activity. For example, a user could choose a midsole more advantageous for practicing for long periods of time or the user could choose a midsole more advantageous for providing peak performance during a match.

In an example of the invention, various portions of the midsoles are provided with different structural features. For example, the heel portion, the forefoot portion, toe portion and/or the arch portion of the midsole can be provided with one or more of a gel structure, a foam structure, and/or a stiffer support structure, such as carbon fiber for example. In this way, the feel of the midsole to the user can be optimized depending on the type of activity of the user.

In a further example of the invention, the structural features of the midsole can be varied between midsoles for the right and left shoes.

According to an example of the invention, one or more projections formed with the midsole are configured to pass through and/or engage apertures in the outsole to thereby secure the midsole portion to the outsole. In addition, and also by way of example, the one or more projections extending from the midsole can help align and/or secure the midsole with the outsole and/or upper of the shoe when connecting the midsole and outsole.

By way of example, at least a part of the one or more projections extend from the midsole and may extend at least partially through the aperture of the outsole.

An example of the invention includes lateral cushioning bumpers. The unique construction of midsole allows the ability to put cushioning in a variety of places in the shoe. The cushioning can be for example, foam, gel, air, etc.

A further example of the invention provides a midsole and stability cup interface. The midsole of one or more embodiments of the invention includes an inter-locking button or projections that fits into a cavity/hole/aperture. The aperture can be located in a stability cup such as a heel counter and midfoot support piece.

A midsole according to an example of the invention is formed at least in part by a gel sheer pattern. The gel sheer pattern can be any shape or pattern and can be placed at any portion of the midsole. Two examples of patterns that can be used are geometries such as radiating and diamond pattern. The patterns can be made of for examples, silicone gel and/or TPE (Superfoam). The gel sheer pattern can be featured on several of the midsoles embodiments of the invention. The gel sheer pattern can sheer when placed in a specific place on the midsole and can create a desirable feeling to the user.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as nonlimiting examples of the invention. In the drawings.

DETAILED DESCRIPTION OF THE PREFERRED EMBODIMENTS

Figure 1:
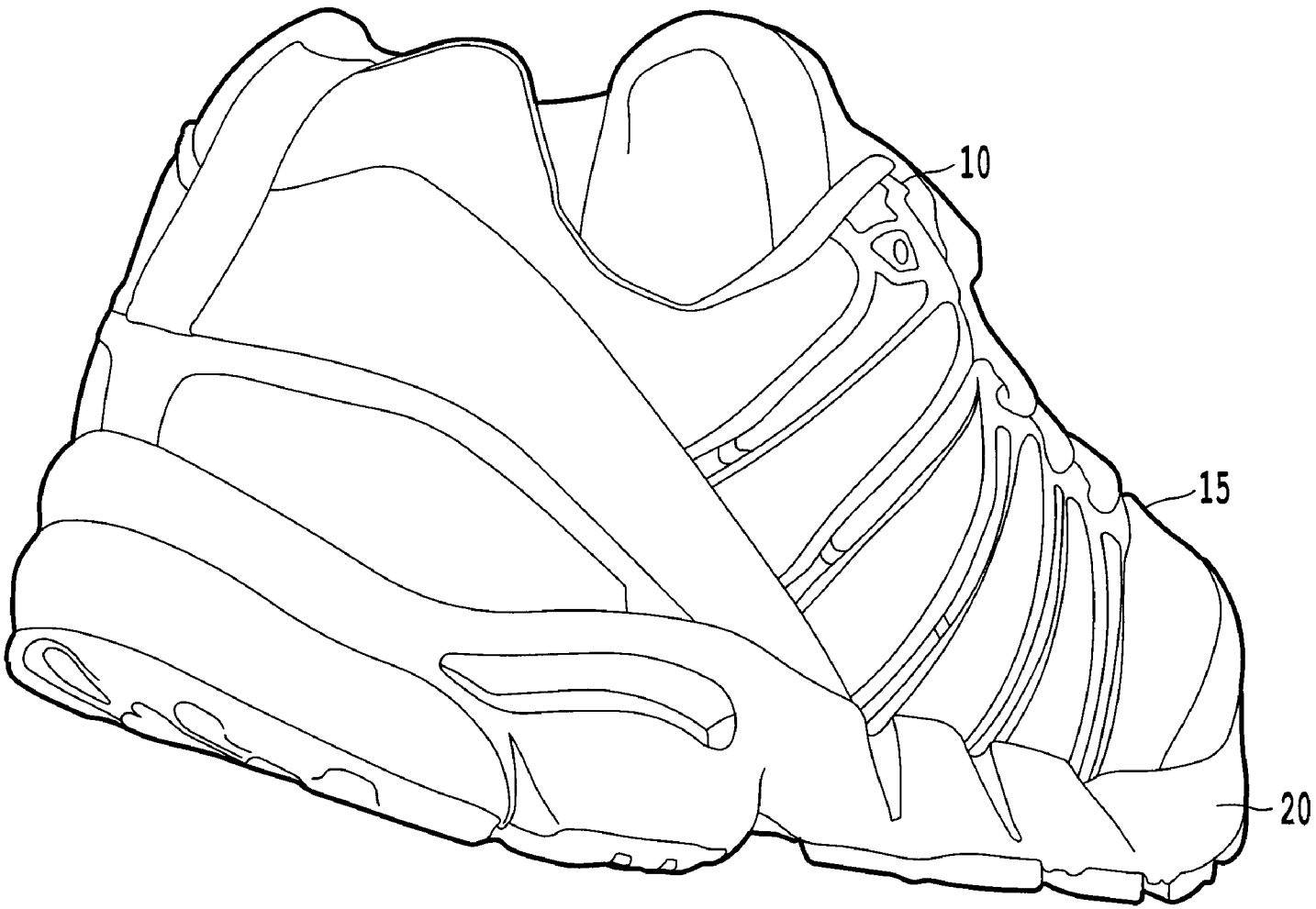
FIG. 1 is a shoe according to an example of the invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 illustrates an example of an embodiment of a shoe 10 of the present invention. The shoe 10, in the illustrated example, is an athletic shoe. Such shoes can be designed for tennis, running, walking, basketball, or other activities. Of course, it should be appreciated that the shoe of exemplary embodiments can be any type of shoe for any use desired by the wearer, which might benefit from the ability to exchange a midsole portion of the shoe. In the illustrated examples, the replaceable portion is provided in the midsole region of the shoe, and the invention has been found to be particularly advantageous in addressing a desire of a user to customize performance of the shoe. The different replaceable midsole portions could be provided that have different material and/or hardness characteristics so that a midsole portion could be replaced that will provide the user with a different feel and/or performance characteristic.

As shown in FIG. 1, the shoe 10 includes an upper portion 15 that covers the upper portion of the wearer's foot. By example, the upper portion 15 may be made of leather, a synthetic or natural fiber material or any combination of materials as is well-known in the art. An outsole 20, as part of a sole assembly, is provided and is typically made of a lightweight material that provides cushioning during use. The shoe outsole 20 has a traction area which extends from a heel end to a forward toe portion and extends across a width of the shoe.

Figure 2:
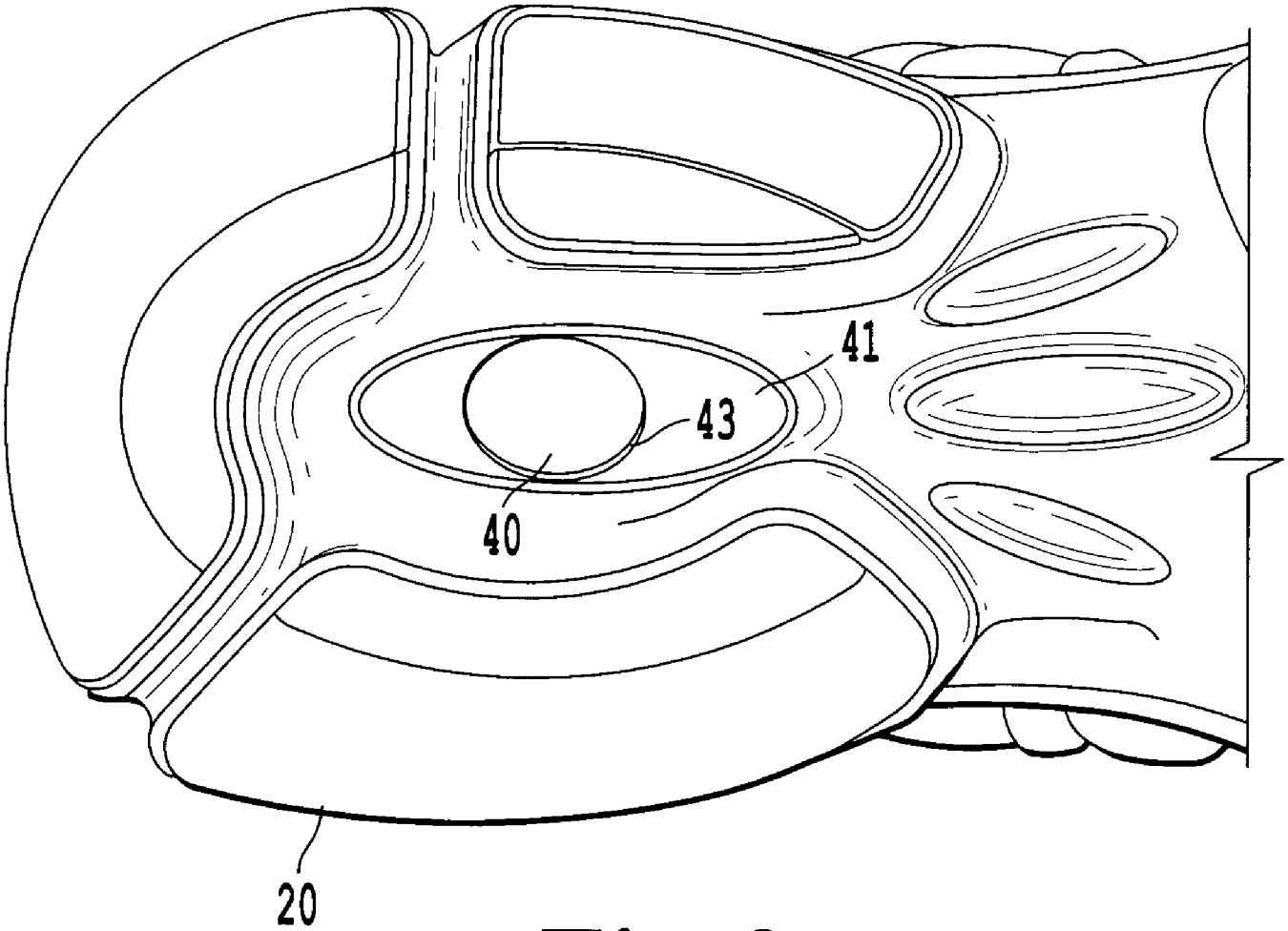
FIG. 2 shows a bottom view of an outsole of a shoe according to an example of the invention.

As shown in FIG. 2, the outsole 20 includes an aperture 40 located in a heel area of the shoe 10 for example. It should be appreciated that aperture 40 can be located at any portion of the outsole 20, for example in an arch area and/or forefoot area and/or in a toe area. Further, it should be appreciated that a plurality of apertures 40 can be provided with the same or different sizes at various locations of the outsole 20. The aperture 40 extends through the outsole 20 into an interior of the upper portion 15. The aperture 40 is provided to allow a projection 32 of the midsole 30, discussed in more detail below, to project there through.

Figure 3A:
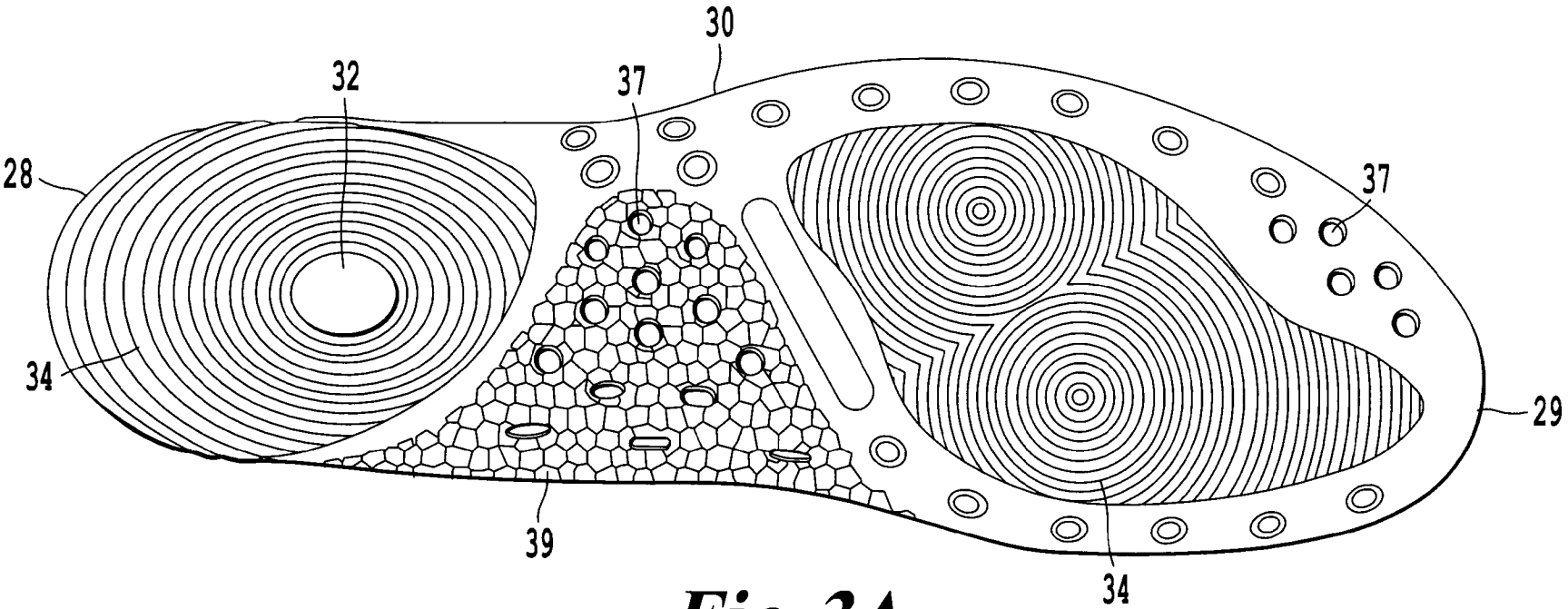
FIG. 3A is a bottom view showing an example of a replaceable midsole that will contact the outsole portion of the shoe after attachment to the shoe.
Figure 3B:
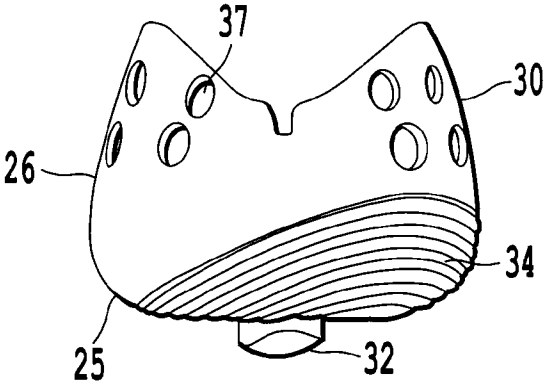
FIG. 3B is a rear view of the midsole shown in FIG. 3A.
Figure 3C:
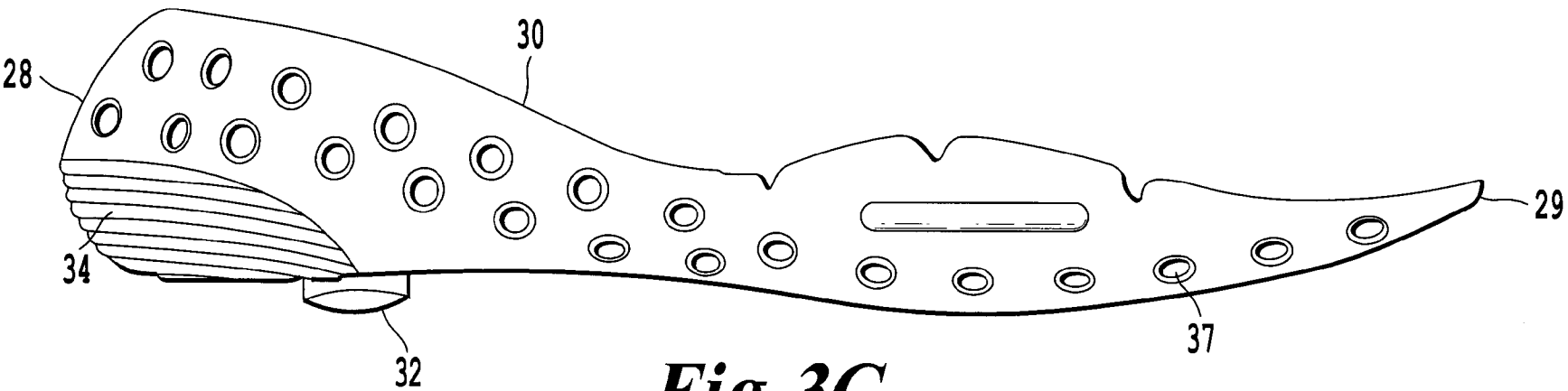
FIG. 3C is a profile view of the midsole shown in FIG. 3A.

According to one of the advantageous aspects of the illustrated example, the shoe 10 includes a removable midsole portion 30, shown in FIGS. 3A-3C for example, that may be easily interchangeable and replaceable with other removable midsole portions 30. That is, a user may wish to alter the performance of the shoe 10 depending on the particular activity. Accordingly, the user can replace the currently used midsole 30 with a more desirable midsole 30. Further, when a midsole 30 becomes worn out or damaged, the user can replace the midsole 30 with a new one instead of having to buy a complete new shoe. The drawings show a right or left midsole 30 but it should be appreciated that the particular structural features of the midsoles will be placed appropriately for a right or left shoe.

An example of the invention provides for the midsole 30 to include the projection 32 for engaging with the outsole 20, which allows a proper alignment and secure connection between the midsole 30 and the outsole 20. As best shown in FIGS. 3B and 3C, the midsole 30 of one or more embodiments of the invention includes a projection 32 that extends downwardly from a bottom surface of the midsole 30. When the midsole 30 is placed in the shoe 10, the projection 32 will extend into the aperture 40 formed in the outsole 20. When the projection 32 extends into the aperture 40 of the outsole 20, the midsole 30 and outsole 20 are thereby secured and ready for use by the wearer. It should be appreciated that the projection 32 may be provided at any location of the midsole 30, for example the arch and/or toe portion of the midsole 30 or along a peripheral or side edge portion of the midsole 30. Further, an example of the invention provides for a plurality of projections 32 and corresponding apertures 40 provided with the midsole 30 and outsole 20 respectively, in order to facilitate proper alignment and a secure connection between the midsole 30 and the outsole 20. When the user wishes to release the midsole 30 and replace it with another midsole 30, the user merely has to press the one or more projections 32 through the one or more apertures 40 and then remove the midsole 30 out through the upper 15.

Figure 4:
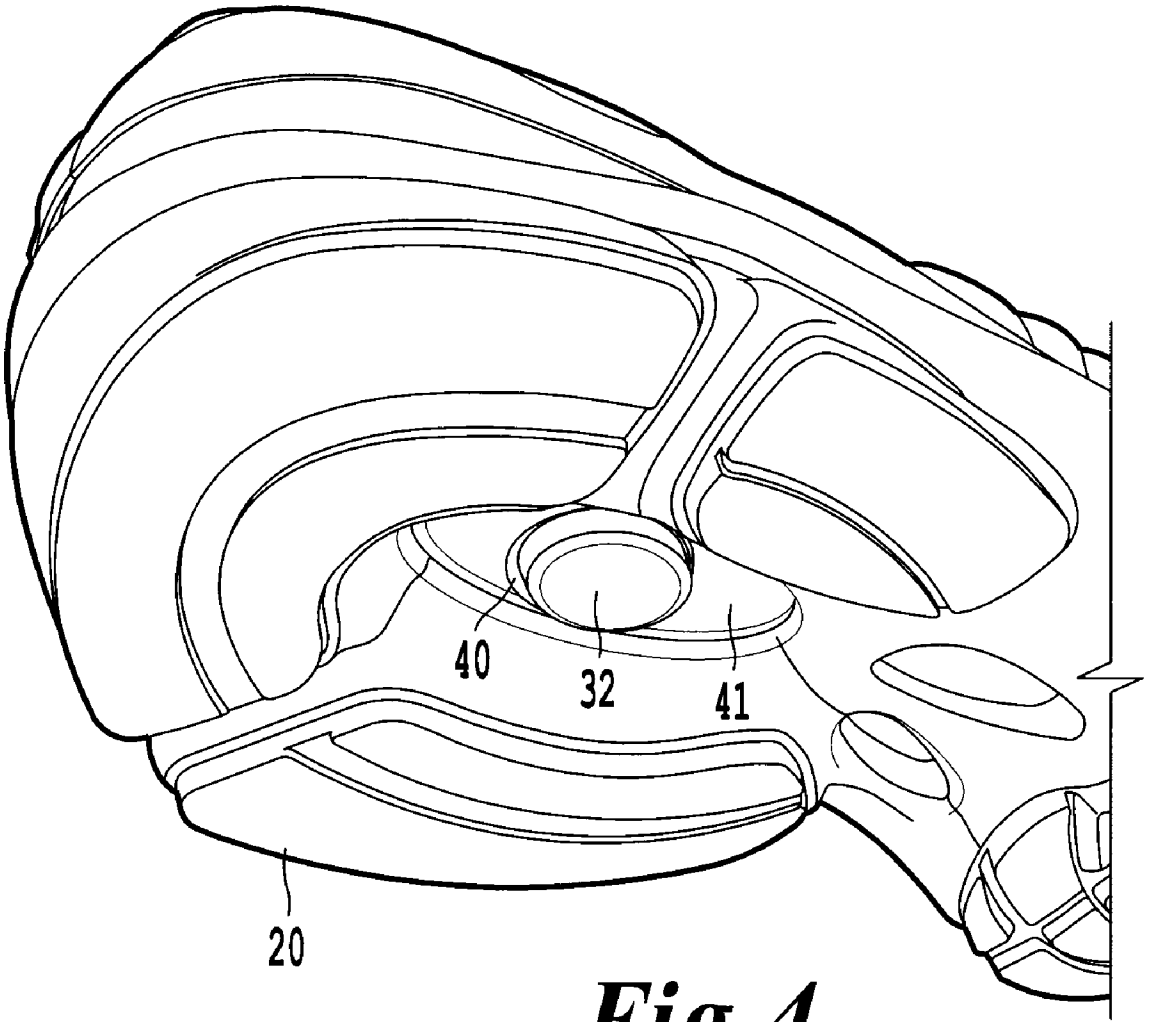
FIG. 4 shows a midsole engaged with an outsole according to an example of the invention.

As best shown in FIG. 4, the aperture 40 can be located in a support piece 41 made of for example, carbon fiber. The support piece 41 can extend from a midfoot area to a heel area, but is not limited as to location or material. In an example of the invention, the aperture 40 is formed directly through the rubber forming the outsole 20. The projection 32 can be made of carbon fiber, plastic or any other suitable material such that the projection 32 will not damage due to contact with the support piece 41. In a further example, the projection 32 can be any size or shape that matches with the size and shape of the aperture 40. For example, as shown in FIG. 2, the aperture 40 is an oval shape. However, it should be appreciated that the aperture 40 can be square, triangular, circular, etc.

According to an example of the invention, the projection 32 can engage with and extend at least partially through the aperture 40 formed in the outsole 20. The projection 32 may be partially visible, for example through the aperture 40, when attached to the shoe or may be at least partially enclosed by the shoe. For example, an inner edge 43 of the aperture 40 can extend downwardly from the support piece 41. In this way, the inner edge 43 will extend along an outside of the projection 32 any desirable length of the projection 32. Varying the length of the inner edge 43 will allow for more surface contact area between the outer side surface of the projection 32 and an inner surface of the inner edge 43 and therefore can further ensure proper alignment and a secure engagement between the projection 32 and aperture 40 and thus between the midsole 30 and outsole 20.

Figure 5:
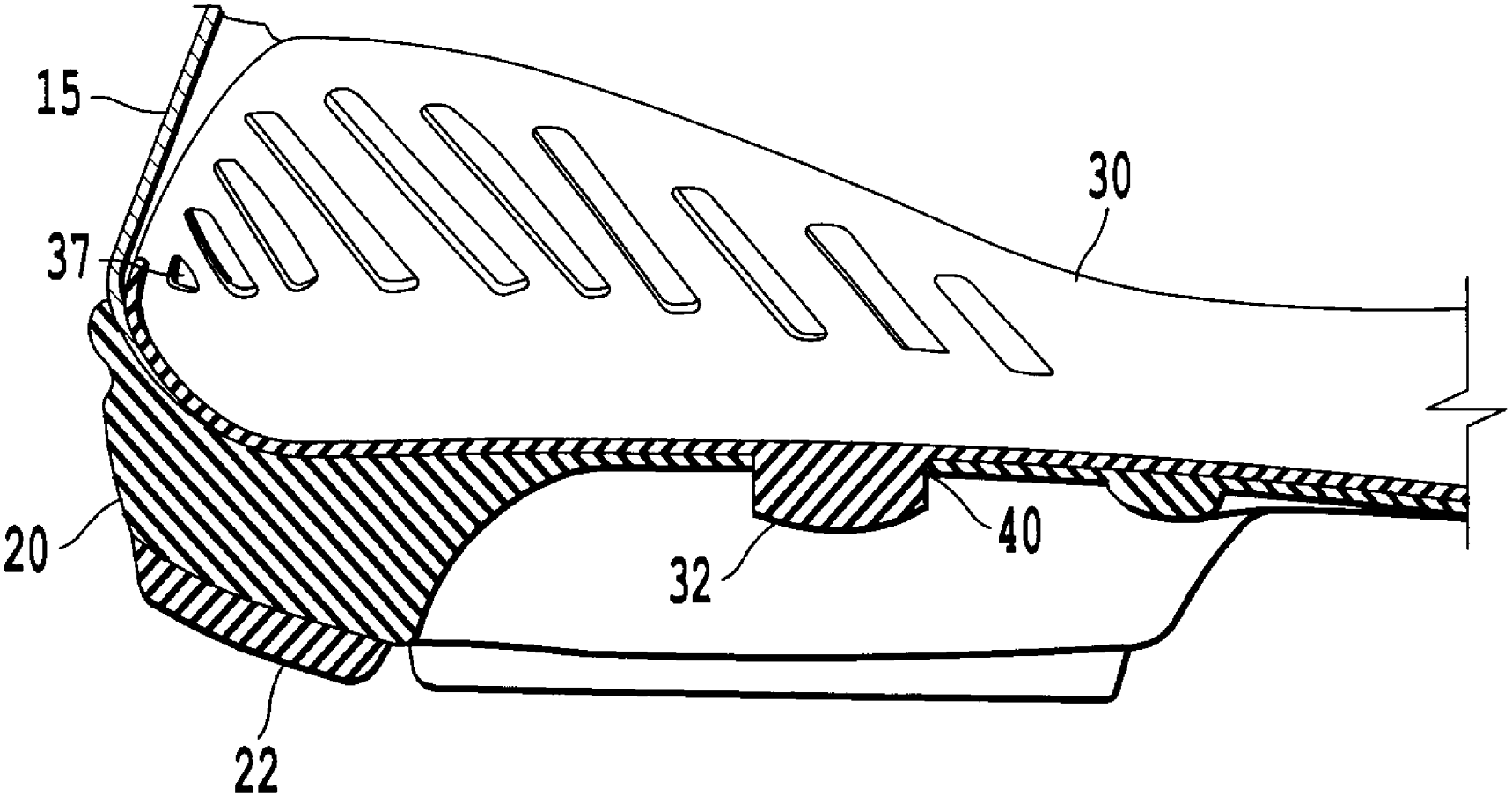
FIG. 5 is a sectional view of a midsole provided in a shoe according to an example of the invention.

As shown in FIG. 5, the projection 32, when extending through the aperture 40, should not extend lower than a ground engaging portion 22 of the outsole in order to avoid contact with the ground surface. The projection 32 can be made of the same or different material than a bottom surface of the outsole 20. For example, the projection 32 may be made of rubber, foam, carbon fiber, plastic, and the like depending on design, aesthetic, performance and/or other factors.

In various exemplary embodiments of the invention shown in the figures, one set of midsole portions 30 may vary from another set of midsole portions 30 by having different structural support elements. The different structural support elements can be portions of the midsole 30 made from different material and/or shaped differently depending on the location on the midsole 30. The variation in the structural support elements provides flexibility to the user to vary the performance of the shoe as desired.

An exemplary midsole 30 of the invention is made of a foam or foam-like material and includes a gel portion 34 that is included as a support element of the midsole 30. The gel portion 34 can be any shape and can be placed along the whole or a portion of the midsole 30. As shown in the example of FIG. 3A, the gel portion 34 is provided at various locations of the midsole from an area around at least a portion of the heel 28 to an area around the forefoot and toe area 29 of the midsole 30. The midsole 30 includes side surfaces 26 extending upwards from the bottom surface 25 and extending around at least a portion of the perimeter of the midsole 30. The gel portion 34 can extend along a heel side surface of the midsole 30. In an example, the gel portion 34 can extend asymmetrically around the heel portion 28 with respect to a medial side surface and lateral side surface.

In the example of FIG. 3A, the gel portion 34 extends up to near an end of the midsole 30 in an area below the big toe of a user. It should be appreciated that the gel portion 34 can extend along part of or the entire bottom and/or side surface of the midsole 30 in the heel area and/or forefoot and/or toe area to provide a desired amount of cushioning to the foot of the user. FIG. 3A shows a radiating circular pattern in the area formed by the gel 34. However, any desirable pattern and geometries such as a diamond pattern, curved lines, and straight lines are within the spirit and scope of the invention.

The gel portion 34 can feature a gel, such as Si18 gel, or gel-like material for long lasting shock absorption and a pillow-like feel. In an example of the invention, a user could insert a midsole 30 into shoe 10 that includes one or more the gel portions 34 when the user is planning on wearing the shoes for a long time. For example, a runner could insert the midsole 30 of FIG. 3A when planning on a long distance run. In a further example, a tennis player could use the midsole 30 of FIG. 3A during a long practice day. In this way, the user can maximize shock absorption and comfort, which can reduce soreness and injury to the body.

An arch support 39 can be included in the midsole 30 shown in the example of FIG. 3A. The arch support 39 can be made of for example, thermoplastic polyurethane (TPU) but other materials can be used as desired, for example carbon fiber. TPU used as an arch support can provide a midsole 30 with good structural integrity and stability for the longer runs or practice days. Similar to the gel portion 34, the arch support 39 can have any desirable pattern and shape and can extend along a bottom portion of the midsole 30 as well as up and along side surfaces of the midsole 30. Holes 37 can be included in the arch support 39 as well as around other areas of the bottom and side surfaces of the midsole 30 to provide ventilation and help keep the shoe cool.

Figure 6A:
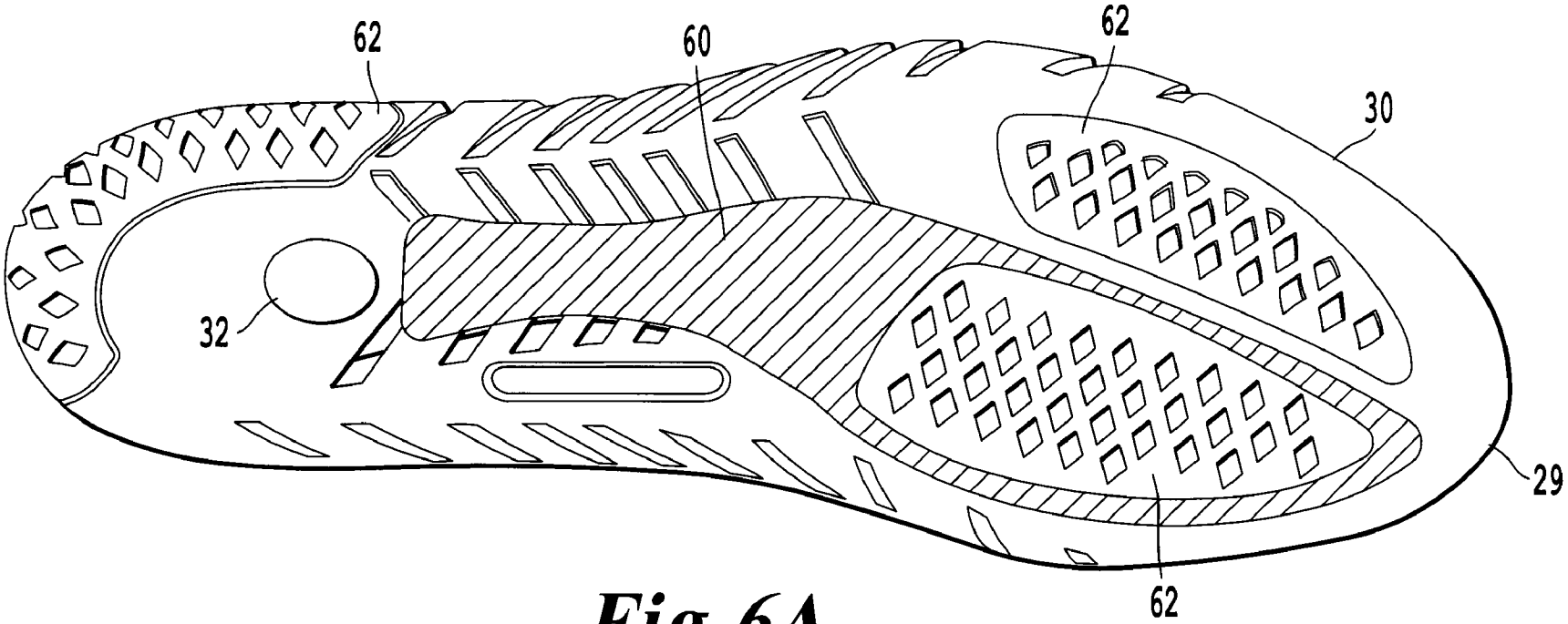
FIG. 6A shows a bottom view of a midsole according to a further example of the invention.
Figure 6B:
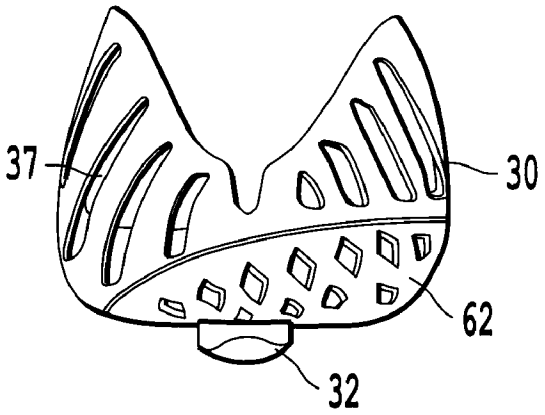
FIG. 6B shows a rear view of the midsole in the example of FIG. 6A.
Figure 6C:
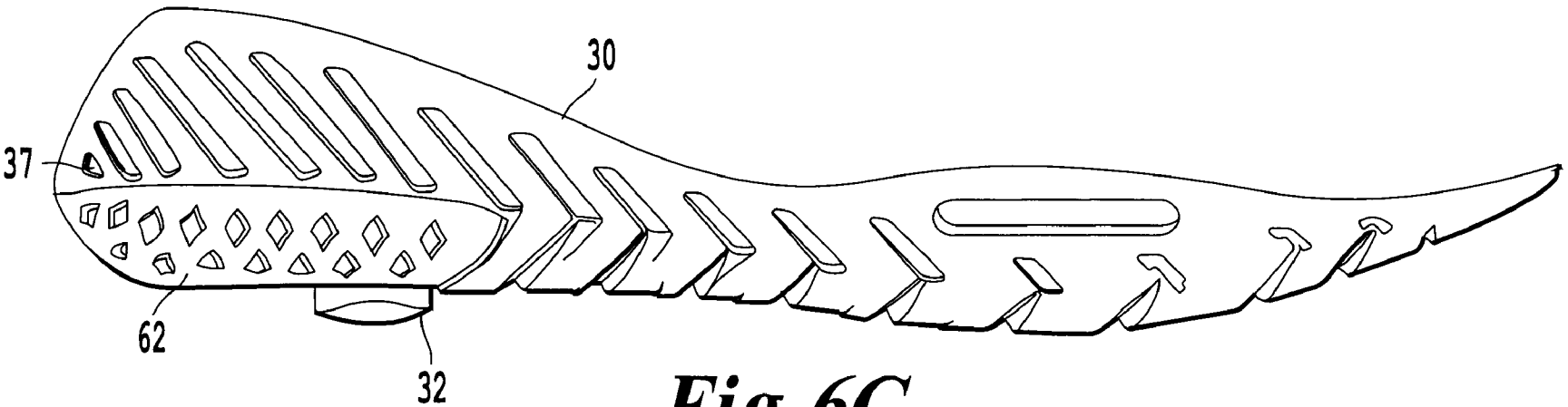
FIG. 6C is a profile view of the midsole example of FIG. 6A.

In a further example of the invention, the midsole 30 shown in FIGS. 6A-6C is a lightweight midsole 30 that can be utilized by the wearer on match days for example, when the lighter weight can increase speed and performance for the wearer. Accordingly, the midsole 30 is formed of a lightweight chassis and includes a spring plate 60 along a portion of the bottom of the midsole, for example from an area near the projection 32 to a toe area 29. The spring plate 60 can enhance the forefoot propulsion and allow the user to move faster. That is, since the spring plate 60 is made from material more firm than the gel 34, the force exerted by the user on the spring plate 60 when running for example, is not absorbed as much as with the gel 34 and the reactionary force acting on the foot of the user is greater.

It should be appreciated that the spring plate 60 can also extend across the width of the midsole 30 as well as extend along the entire length of the midsole 30. Additionally, the spring plate 60 can extend up and along the side surfaces of the midsole 30. The spring plate 60 can be made of carbon fiber for example, which due to its high strength-to-weight ratio, makes it an ideal material when an activity requires low weight but still must provide adequate support for the user.

The spring plate 60 can extend continuously along a bottom of the midsole 30 or can include an area having a foam material 62 provided in a portion thereof, as shown in FIG. 6A. A foam insert 62 can provide lightweight high energy return for improved agility during competitive play and can provide a springy feel. According to an example of the invention, other portions of the midsole 30 can include foam material 62. As shown in FIGS. 6A-6C, the foam insert 62 can be provided in an area of the heel along the bottom and/or side walls surfaces of the midsole 30. Further, foam insert 62 can be provided in an area of the forefoot and/or toe region in a different location than the foam insert 62 provided in the spring plate 60.

Figure 7:
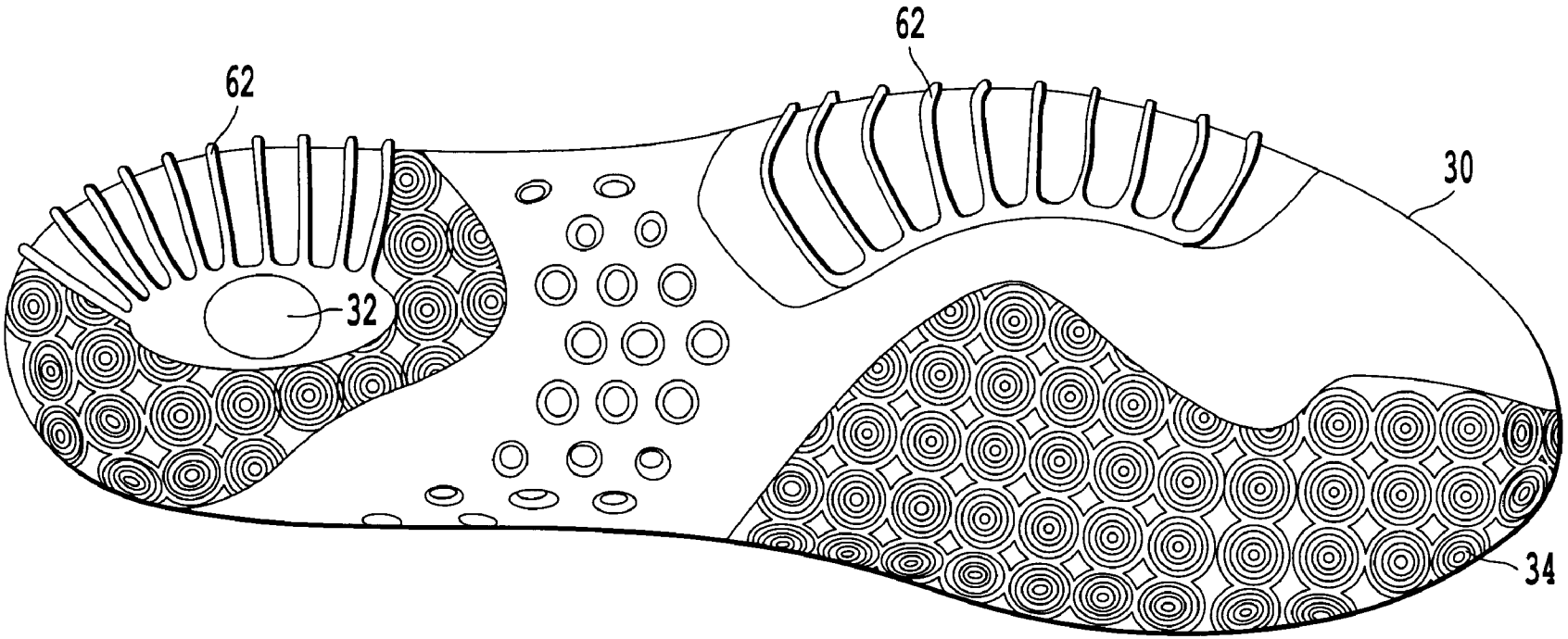
FIG. 7 is a midsole according to a further example of the invention.
Figure 8:
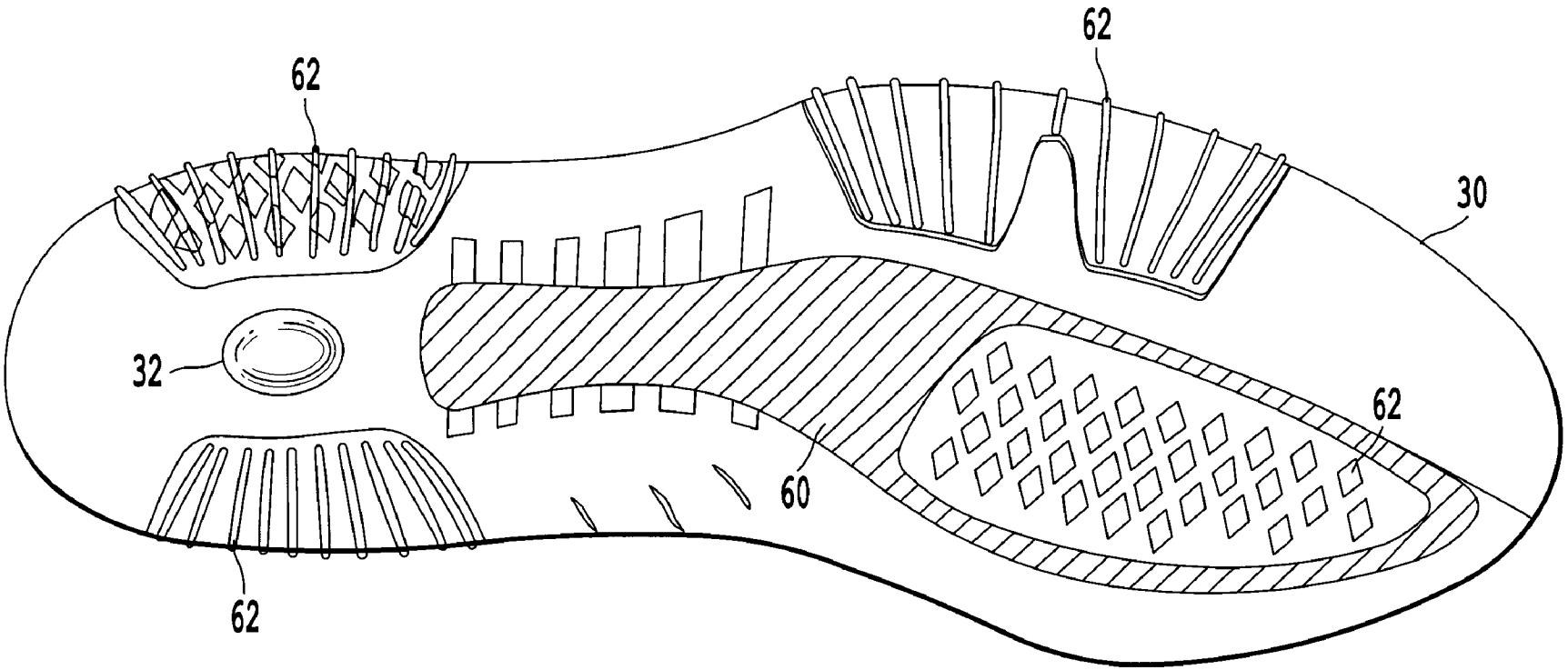
FIG. 8 shows a midsole according to a further example of the invention.

It should be appreciated that foam inserts 62 can be located at any desirable location of the midsole 30 to provide a high energy return for improved performance. For example, as shown in FIG. 7, foam inserts 62 can be provided in a finger-like fashion along the bottom and side surfaces of the midsole 30. The finger-like foam inserts 62 can be located in the heel region as well as the forefoot, toe, and/or arch areas as well as any other location on the bottom and side surfaces of the midsole 30. FIG. 8 shows a further example of the invention including various combinations of sizes, shapes, and locations of structural support elements such as spring plate 60 and foam inserts 62 for example.

As discussed above, in an example of the invention, one set of midsoles 30 can be primarily used for long runs or practice days while another set of midsoles 30 can be used for shorter runs or matches. It should be appreciated that further examples of the invention provide for the midsoles 30 of a particular set to be asymmetrical. That is, one or more structural support elements of a midsole 30 used in a right shoe can be different in location, size, depth, texture, and/or material from a midsole 30 used in a left shoe. In an example of the invention, a runner can have greater stability cushioning in the left shoe while having neutral cushioning in the right shoe. The stability cushioning in the left shoe could be provided by a greater area of the midsole 30 formed by the spring plate. A more neutral cushioning in the right shoe could be provided by a greater area of gel portion 34. As right and left shoes can have different functions from each other depending on the type and location of an activity, midsoles 30 for right and left shoes according to one or more embodiments, can differ accordingly.

Figure 9:
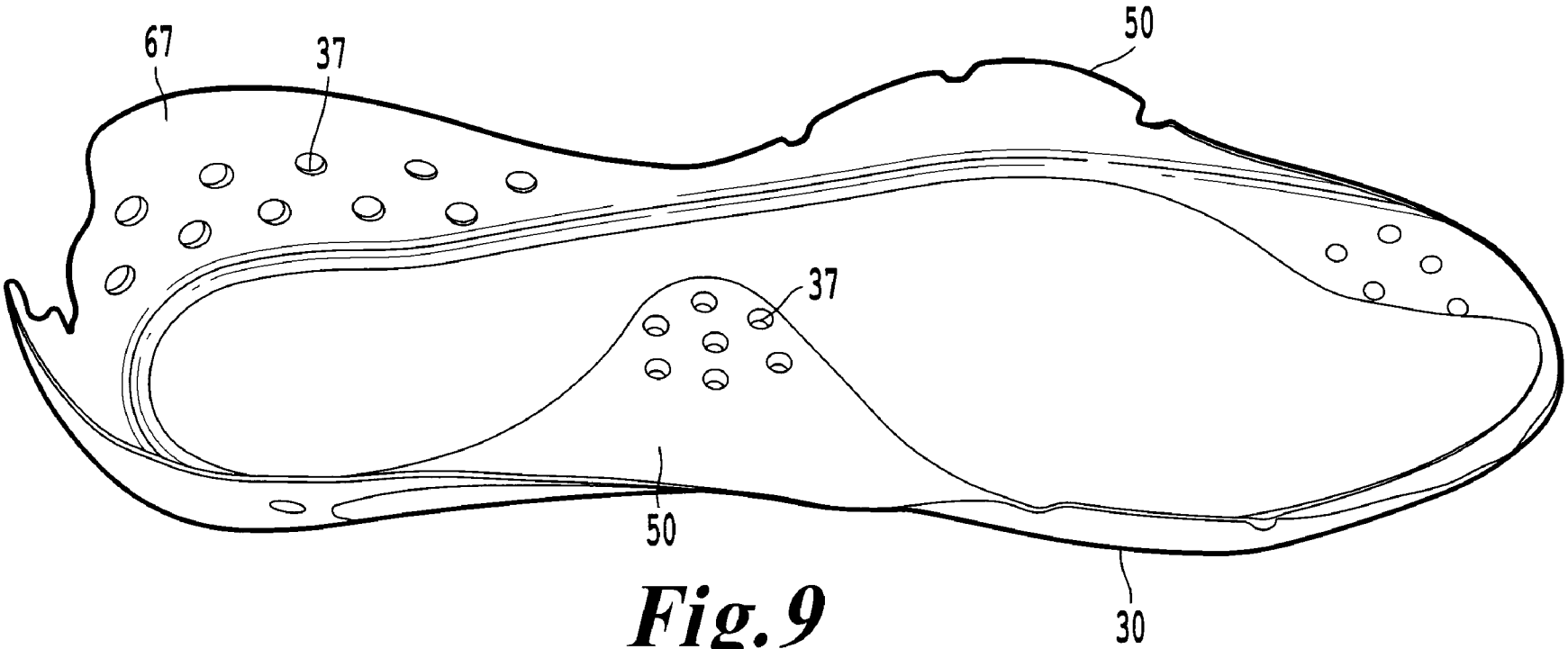
FIG. 9 is an oblique top view of a midsole according to an example of the invention.

As shown in FIG. 9, the midsole 30 according to an example of the invention can also include a high density heel wrap 67 formed around all or a portion of the heel. For example, the heel wrap 67 can be provided along approximately 270 degrees of the heel. The heel wrap 67 can be made of a polymer, such as Ethylene vinyl acetate (EVA) or similar type material that provides softness, flexibility and shock absorbing properties. The heel wrap 67 can provide extra support for higher endurance when participating in an activity and can also provide extra impact protection for the heel.

As further shown in FIG. 9, according to one of the advantageous aspects of the illustrated example, a peripheral or lateral edge portion 50 of the midsole 30 can extend upwardly with respect to a bottom plane of the midsole 30. An example of the invention includes these lateral cushioning bumpers 50. The unique construction of midsole 30 allows the ability to put cushioning bumpers in any desirable place on the midsole 30. The cushioning bumpers 50 can be for example, foam, gel, etc., but can be made from any material that can be used for cushioning. It should be understood that the shape of the bumpers 50 can be any shape or size and be at any location in and around, and at any part of the midsole 30. In an example, the bumpers 50 can have holes 37, can be substantially solid, can have notches cut out of the top, etc. In this way, the performance, appearance, functionality of the shoe can be enhanced in addition to easing the interchangeability of the midsole 30. In accordance with this feature of an example of the invention, when a user is wearing the shoes, forward and lateral starting and stopping forces the foot to collide with the side and/or front of the shoe causing discomfort and possibly "black toe" (bruising under the toe nails). The lateral, medial and/or toe bumpers 50 provided with the midsole construction help reduce or eliminate this problem.

In an example of the invention, an identification device, such as a tab, can be provided in the heel portion of the midsole 30 to help identify the particular midsole with words or colors, and can also help the user pull out the midsole 30 from the inside of shoe 10. In a further example of the invention, the midsole 30 and outsole 20 can be connected by a twisting or other such movement of the projection 32 to allow the projection 32 to engage one or more portions of the outsole 20 in a secure manner.

In a further example of the invention, the midsole 30 can be connected to the outsole 20 by way of a threaded stud (not shown) configured to pass through the aperture in the outsole 20 and threadedly engage threaded bores provided in the midsole 30, thereby affixing the interchangeable midsole 30 to the outsole 20. It should be appreciated that any number of studs may be used to secure the midsole 30 to the outsole 20 in order to provide a secure connection and not affect the performance of the shoe for the user. The stud could be secured to the midsole 30 by twisting or the like by the user or can be secured using a device that engages the stud and facilitates rotation of the stud.

Further, it should be appreciated that the exemplary embodiments of the invention are not limited to the exemplary replaceable toe portion shown and described above. While this invention has been described in conjunction with exemplary embodiments outlined above, various alternatives, modifications, variations and/or improvements, whether known or that are, or may be, presently unforeseen, may become apparent. Accordingly, the exemplary embodiments of the invention, as set forth above are intended to be illustrative, not limiting. The various changes may be made without departing from the spirit and scope of the invention. Therefore, the replaceable toe portion of a shoe and the systems and methods of replacing the toe portion according to exemplary embodiments of this invention are intended to embrace all now known or later-developed alternatives, modifications, variations and/or improvements.

The invention claimed is:

1. A shoe, comprising:

an upper adapted to receive a foot;

an outsole secured to the upper, the outsole including a ground engaging surface, and a surface defining at least one aperture extending therethrough; and a midsole which, in a mounted position, is removably positioned in the upper, the midsole including at least one projection extending through the at least one aperture formed in the outsole such that a portion of the at least one projection is exposed and accessible from a bottom of the shoe and application of a force to said portion displaces the midsole from said mounted position for removal of the midsole from the shoe, and further wherein in the mounted position the at least projection is held within the at least one aperture to secure the midsole to the outsole, wherein the midsole includes a plurality of support portions in heel and forefoot areas of the midsole, and the heel and forefoot area are removed together upon removal of the midsole.

2. The shoe according to claim 1, wherein the at least one projection extends from a bottom surface of the heel area of the midsole.

3. The shoe according to claim 2, wherein at least one of the plurality of support portions is formed from a gel material and another of the plurality of support portions is formed from a non-gel material.

4. The shoe according to claim 3, wherein the midsole includes a first gel support portion located in the heel area, and a second gel support portion separate from the first, located in the forefoot area of the midsole.

5. The shoe according to claim 4, wherein the second gel support portion extends from a midfoot area of the midsole to a toe area of the midsole.

6. The shoe according to claim 4, wherein the first and second gel support portions are separated by the non-gel material support portion.

7. The shoe according to claim 4, wherein the midsole includes a side wall portion extending upwardly from at least part of a peripheral region of the bottom surface, and wherein the first gel portion extends at least partially along the side wall in the heel area of the midsole.

8. The shoe according to claim 7, wherein the first gel portion extending along the side wall extends asymmetrically in the heel area such that a greater area of the first gel portion is positioned on an outer lateral side compared to an inner medial side.

9. The shoe according to claim 6, wherein the non-gel support portion comprises thermoplastic polyurethane.

10. The shoe according to claim 6, wherein the non-gel material support portion is formed in an arch area of the midsole and extends along a portion of the bottom surface of the midsole and also along a portion of a side wall of the midsole.

11. The shoe according to claim 2, wherein at least one of the plurality of support portions comprises a foam material and another of the plurality of support portions comprises a non-foam material.

12. The shoe according to claim 11, wherein the midsole includes a first foam support portion located in the heel area and at least one foam support portion located in a forefoot portion of the midsole.

13. The shoe according to claim 11, wherein the non-foam support portion extends in a longitudinal direction of the midsole from an area at or near the projection to an area at or near a toe portion of the midsole.

14. The shoe according to claim 13, wherein the non-foam support portion comprises carbon fiber.

15. The shoe according to claim 12, wherein the midsole includes a side wall portion extending upwardly from at least part of a peripheral region of the bottom surface, and wherein the first foam support portion extends asymmetrically at least partially along the side wall in the heel area of the midsole.

16. The shoe according to claim 1, wherein the shoe includes a first and second shoe, the first shoe including a first midsole and the second shoe including a second midsole, and wherein at least one of the plurality of support portions for the first midsole is different from at least one of the plurality of support portions for the second midsole.

17. The shoe according to claim 1, wherein the outsole includes a support plate defining the aperture, the support plate formed of a different material than the ground engaging surface of the outsole.

18. The shoe according to claim 17, wherein the ground engaging surface of the outsole is located a first distance below a bottom surface of the support plate, and in the mounted position, the projection extends a second distance below the bottom surface of the support plate, with the first distance being greater than the second distance, such that in the mounted position a lowest portion of the projection extends below the bottom surface of the support plate but is above the ground engaging surface of the outsole.

19. The shoe according to claim 1, wherein the shoe is a tennis shoe.

20. The shoe according to claim 1, wherein the outsole includes a ground engaging surface and a recessed portion that is recessed from the ground engaging surface, and further wherein the aperture of the outsole extends from a top surface of the outsole, through the outsole and into the recessed portion;

wherein in the mounted position, the projection extends through the aperture and into the recess, such that a portion of the projection is exposed in said recess and said projection is accessible by way of the recess to be urged by hand to remove the midsole from the mounted position; and wherein in the mounted position, the projection is exposed within said recessed portion and is spaced from said ground engaging such that when a user wears and uses the shoe on a ground surface, the lowermost part of the projection is maintained spaced from the ground surface.

21. The show of claim 20, wherein the outsole includes a support plate, wherein said aperture extends through the support plate, and wherein the midsole is positioned above the support plate; and wherein the midsole includes a support portion formed with a gel material disposed above said support plate in the mounted position, and the projection extends from said support portion within a region comprising said gel material.

22. The shoe of claim 21, wherein the support plate is formed of carbon fiber.

* * * * *